US005842674A

United States Patent [19]

Freeman

[11] Patent Number: 5,842,674

[45] Date of Patent: Dec. 1, 1998

[54] FURNITURE IMPACT CUSHION

[76] Inventor: James W. Freeman, 20253 Gifford St., Winnetka, Calif. 91306-3210

[21] Appl. No.: 838,800

[22] Filed: Apr. 10, 1997

[51] Int. Cl.[6] ..... A47B 95/00

[52] U.S. Cl. ..... 248/345.1; 16/86 A

[58] Field of Search ..... 248/345.1, 205.4, 248/346.2; 16/DIG. 2, 86 A, 86 R; 405/215; 52/204.591; 108/27

[56] References Cited

U.S. PATENT DOCUMENTS

| | | |
|---|---|---|
| D. 348,175 | 6/1994 | Kilbey . |
| D. 356,352 | 3/1995 | Johnson . |
| 993,119 | 5/1911 | Stannard . |
| 1,312,110 | 8/1919 | Duncan et al. . |
| 3,346,892 | 10/1967 | Priest . |
| 4,876,755 | 10/1989 | Parrish . |
| 5,573,014 | 11/1996 | Ginter . |

FOREIGN PATENT DOCUMENTS

| | | |
|---|---|---|
| 7843/32 | 6/1932 | Australia . |

*Primary Examiner*—Ramon O. Ramirez
*Assistant Examiner*—Willie Berry, Jr.
*Attorney, Agent, or Firm*—Clifford A. Poff

[57] ABSTRACT

A furniture cushion for limiting the effects of impact of an item of furniture with a stationary object is disclosed. The cushion includes a cylindrical pad portion made of a highly elastic material, such as polyurethane, which is adhered to an attachment portion made from a relatively non-elastic polyethylene material. The cushion further includes tab portions for attachment of the cushion to the item of furniture. The disclosed cushion also includes material saving recesses in the attachment portion which are separated by dividers for limiting potentially detrimental flexing of the attachment portion.

17 Claims, 3 Drawing Sheets

FURNITURE IMPACT CUSHION

BACKGROUND OF THE INVENTION

The present invention relates generally to furniture, and more particularly to the reduction of the negative effects resulting from impact of items of furniture with stationary objects, such as a wall. It is not uncommon that items of furniture, such as a beds or chairs, which are located adjacent to a wall, will come into contact with such a wall during normal usage of the item. The impact of the item with the wall will frequently result in an undesirable percussion creating a potential annoyance to occupants in neighboring rooms. Such contact may also result in impact and abrasion damage to the wall as well as to the item of furniture. This could lead to the necessity of costly repairs.

It may not always be known in advance precisely which portion of an item of furniture will be subject to such impacting with other surfaces, such as a wall. The provision of padding in advance, for example during fabrication of the item, would therefore require either the unsightly padding of an entire surface of the item, or the addition of smaller pads at less than precise locations. What is needed is padding which can be attached to the item of furniture in precise locations to serve as a buffer between the item of furniture and the wall and yet which may be small enough so as not to detract unnecessarily from the natural appearance of the item.

Accordingly, it is an object of the present invention to provide an impact cushion which is attachable to an item of furniture for providing a buffer between the wall and that portion of the item which would otherwise contact with the wall.

It is yet a further object of the present invention to provide an impact cushion which is attachable to an item of furniture to serve as a buffer without affecting unnecessarily the natural appearance of the item of furniture.

SUMMARY OF THE INVENTION

According to the present invention there is provided a cushion for an item of furniture for limiting impact effects caused by contact of the item with a stationary object. The impact cushion includes a furniture attachment portion having a first face capable of overlying a surface of such an item of furniture and an opposite second face, the attachment portion further including means for attaching the attachment portion to the surface of such an item of furniture; and a pad portion extending from the second face of the attachment portion for contact with such a stationary object.

BRIEF DESCRIPTION OF THE DRAWINGS

The present invention will be more fully understood when the following description is read in light of the accompanying drawings in which.

DETAILED DESCRIPTION OF THE PREFERRED EMBODIMENTS

Figure 1:
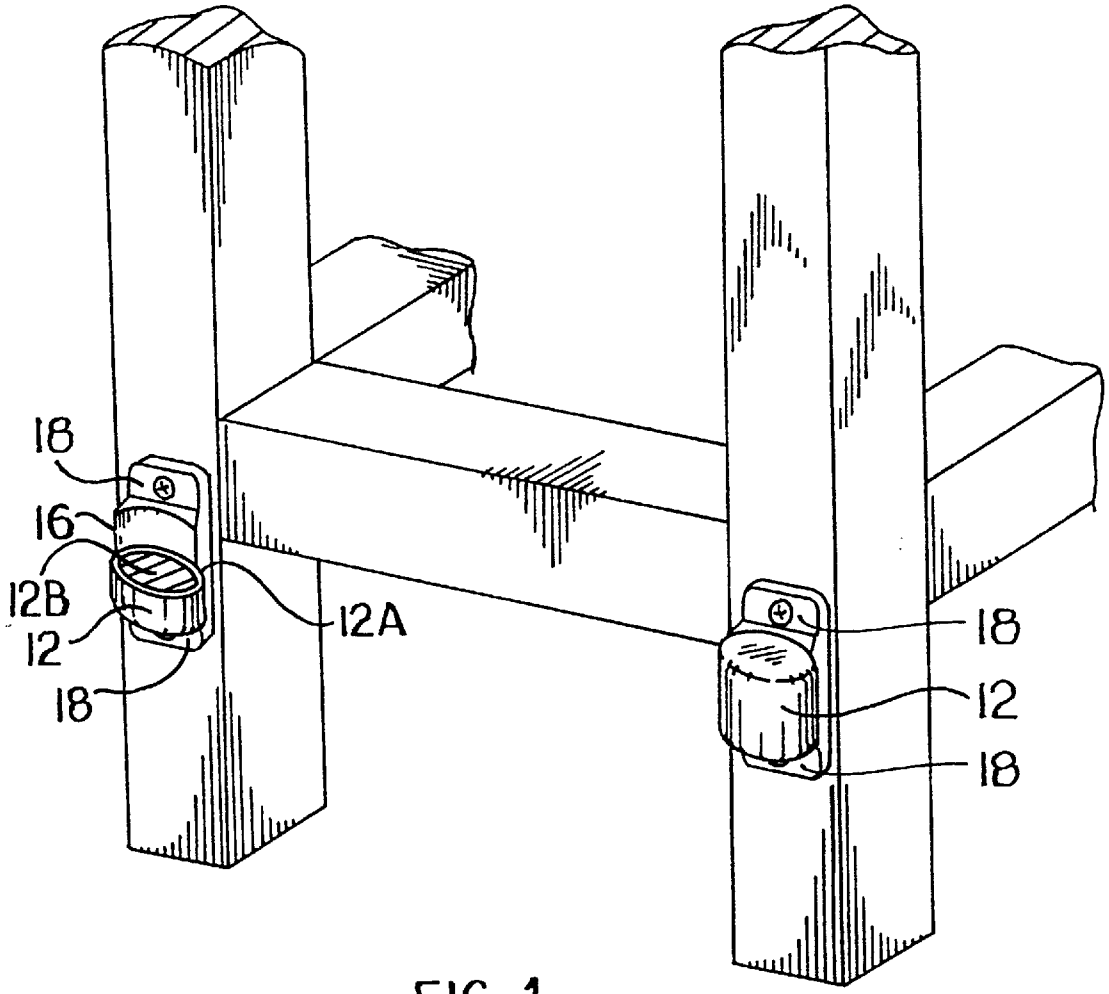
FIG. 1 is a perspective view of a bed frame on which furniture impact cushions according to the present invention have been attached.

Referring to FIG. 1, there is shown a bed frame 8 to which impact cushions 10 according to the present invention have been attached.

Figure 2:
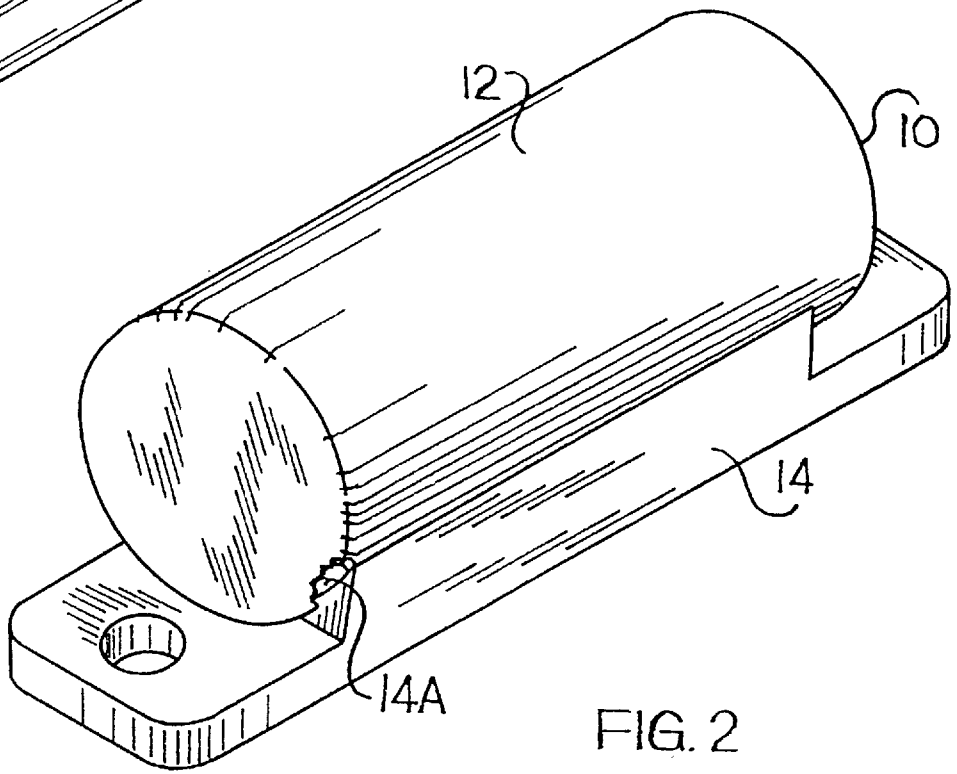
FIG. 2 is a perspective view of a furniture impact cushion according to the present invention.

Turning to FIG. 2, there is shown a perspective view of a furniture impact cushion 10 according to the present invention. The impact cushion includes a pad portion 12 which is cylindrical in shape. The pad portion is preferably made from a foaming polymeric material, such as a polyurethane which has the capability of elastic response after being subjected to up to fifty percent compression. The pad portion 12 is formed in a mold cavity wherein polymetric material mixed with a foaming agent additive expands against the mold walls under sufficient pressure to form a dense, essentially pore free, outer skin 12A that enveloping a molded foamed eleastomeric core 12B. The impact cushion also includes a furniture attachment portion 14 from which the pad portion extends. The attachment portion is made of plastic, most preferably a non-foaming polymeric material such as polyethylene, which is therefore relatively non-elastic in nature in comparison to the pad portion 12. The construction of the furniture impact cushion of FIG. 1 therefore represents an ideal combination of components, in that the pad 12 provides for elastic response at the point of contact between the cushion 10 and a stationary object, such as a wall, while in contrast the non-elastic attachment portion provides a stable foundation for attachment of the pad portion to the attachment portion as well as for attachment of the impact cushion to the item of furniture.

Figure 3:
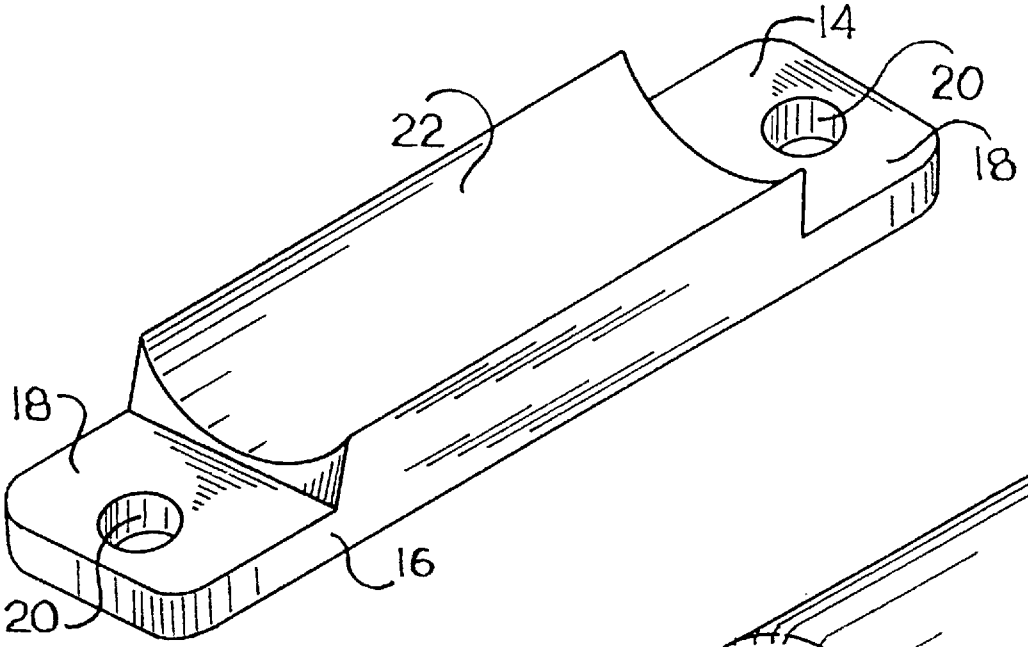
FIG. 3 is a perspective view of the attachment portion of the furniture impact cushion of FIG. 2.

Turning to FIG. 3, a perspective view of the attachment portion 14 of the impact cushion 10 of FIG. 1 is shown. The attachment portion has a first face 16 which is designed to overlay and contact a surface on the item of furniture, such as bed frame 8 of FIG. 1, on which the impact cushion will be located. The attachment portion also includes tab portions 18 which are located at opposing ends of the cushion. Each of the tab portions 18 includes an opening 20 for receiving a connector, such as a screw suitable for use on the particular item of furniture to which the cushion is to be attached. The attachment portion further includes a second face 22 which is opposite from the first face 16. The second face 22 presents a concave surface onto which a portion of the cylindrical pad 12 will confront the concave surface in an interfitting relationship. The pad portion 12, which was seen in FIG. 1, will be maintained in position in the interfitting relationship with the concave surface of the attachment portion 14 through the use of a suitable adherent, there being shown a fillet 14A (FIG. 2) of adhesive adjacent the interfitting surfaces to provide an adhesive bond of long continued integrity.

Figure 4B:
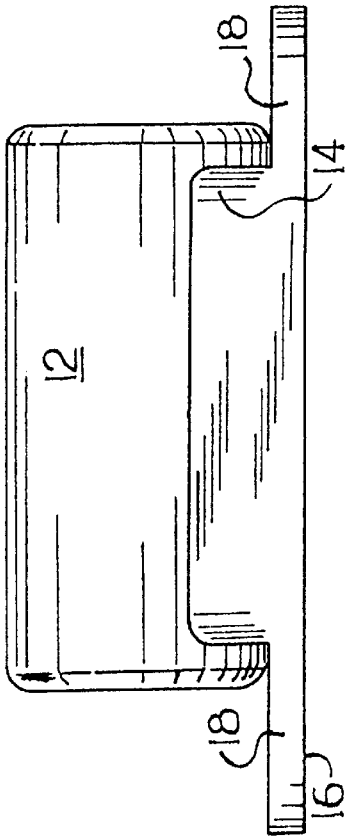
FIGS. 4A and 4B are bottom and side views, respectively, of the attachment portion of the furniture impact cushion of FIG. 2.
Figure 4A:
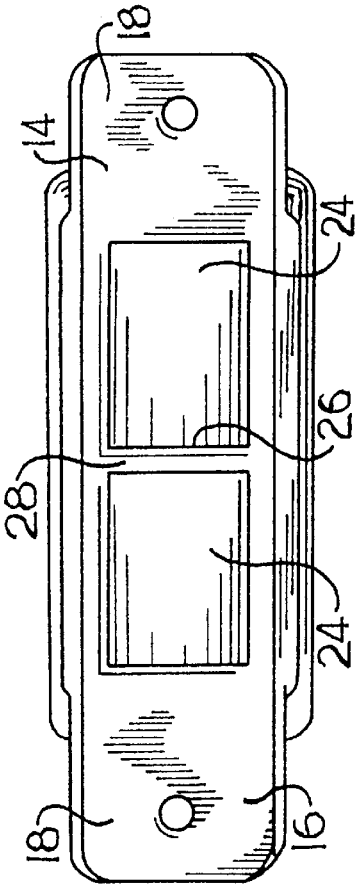

Turning to FIGS. 4A and 4B, an additional feature is seen in which the first face 16 of the attachment portion includes recessed portions 24 which serve to significantly reduce the amount of the non-elastic polymer required without hindering the capability and desired functioning of the attachment portion. Because the recessed portions extend in total length for essentially the entire length of the first face which opposes the second face upon which the pad portion 12 is mounted, a divider 26 is included to separate adjoining recessed portions 24. The divider includes a first face portion 28 which is designed to overlay and contact the surface of the item of furniture on which the cushion is to be mounted. The divider constitutes a structural member which serves to resist undesirable flexing of the attachment member which might otherwise occur were the recessed portion to extend unbroken for nearly the entire length of the first face 16 opposing the second face 22. Such undesirable flexing of the attachment portion could jeopardize the integrity of the adhesive bond which maintains the pad portion 12 in interfitting relation with the attachment member 14.

Figure 6:
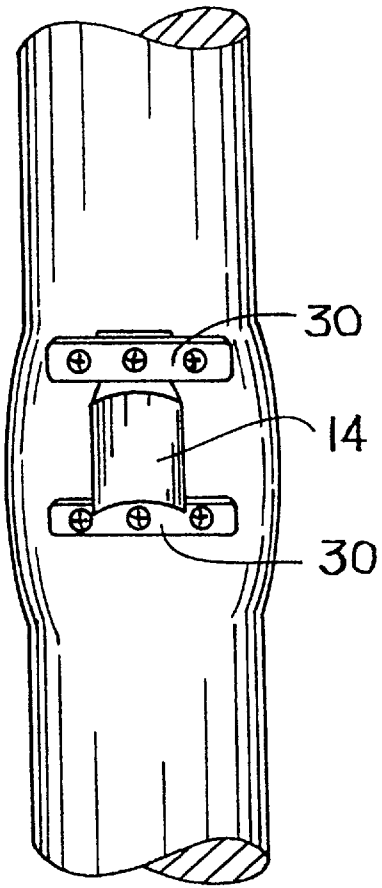
FIG. 6 is a view of a bed post having a non-planar surface on which an impact cushion has been attached using the attachment strap of FIGS. 5A and 5B.
Figure 5A:
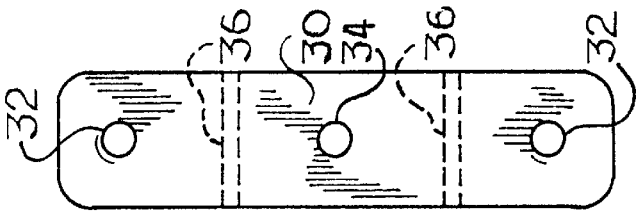
FIGS. 5A and 5B are plan and side views respectively, of an attachment strap for attachment of the impact cushion of FIG. 2 to a non-planar surface.
Figure 5B:
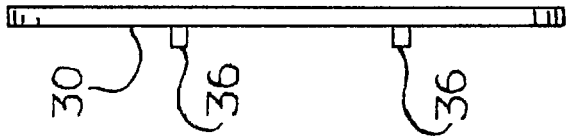

Turning to FIGS. 5A and 5B, there is seen an attachment strap 30 for attachment of the cushion of FIGS. 1–3 to a non-planar surface of an item of furniture, such as a cylindrical bed post as seen in FIG. 6. For such a surface, the contact between the generally planar first face 16 of the attachment portion 14 and the non-planar surface will not be complete. Connection of the cushion solely by way of the tab portions 18 in such a case would result in a less stable connection than would occur through the use of such a connection to a planar surface of an item of furniture.

Each strap 30 has an elongated length and openings 32 located adjacent to opposing ends of the elongated length. The strap further includes a generally centrally located opening 34 which will overly one of the openings 20 in a tab portion 18. The strap is constructed to be thin in cross-section so as to be conformable along its length to the non-planar surface of the item of furniture. Each strap also includes spaced apart cleat portions 36 extending from one of its faces for positioning of the strap with respect to one of the tab portions 18. Each of the straps is attached to the attachment portion 14 and the item of furniture through central opening 34 and to the item of furniture at each of the opposing end openings 32 to the item of furniture. The length of the strap is designed to provide for a stable connection without being overly long and thereby potentially detracting from the natural appearance of the item of furniture. It has been found that an overall length of between 3 to 4 inches is sufficient and most preferably between 3 to 3.5 inches. For similar reasons, this construction is believed to be superior to one which involves complete encirclement by the strap of a portion, such as a bedpost, of the item of furniture.

Figure 7:
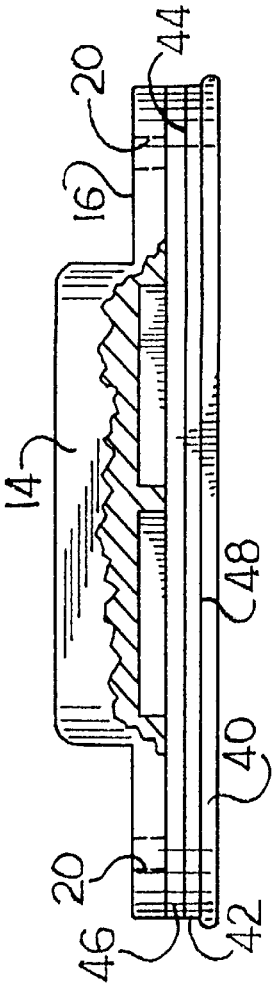
FIG. 7 is a side view of an alternative attachment for attaching an impact cushion to a non-planar surface, the alternative attachment including a layer of moldable material.

Turning to FIG. 7, there is seen another means of attaching the impact cushion of FIGS. 1–4 to a non-planar surface of an item of furniture, such as a bedpost. The attachment means includes a layer 40 of moldable material, such as PLAY-DOH®, plumber's putty, or other commercially available products which harden upon air-drying. The moldable material is carried on a plate 42 having a first face 44 on which a layer 46 of adhesive material is located for attachment of the plate 42 to the first face 16 of the attachment portion 14. The plate has a second face 48 opposite from the first face 44 to which the layer 40 of moldable material is attached. Once the cushion has been placed in position on the item of furniture, the cushion is secured to the item of furniture through the attachment tabs 18 in a similar fashion to the discussion above in regard to FIG. 2. Upon hardening of layer 40, the interfitting relation between layer 40 and the surface of the item of furniture will provide stability to the connection which would be lacking were the attachment portion connected to the item of furniture directly through the tab portions 18. It is conceivable for the moldable material to be exposed to air either before or after the layer 40 is conformed to the surface of the item of furniture. For example, the moldable layer itself may be located within a flexible container, such as plastic, which is conformable to the surface of the item of furniture, and which will be penetrated by the means of connection, such as wood screws, through openings 20 in the tab portions and through the layer 40. Such penetration would expose the moldable material to the surrounding air allowing for hardening of the material.

While the present invention has been described in connection with the preferred embodiment of the various FIGS., it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A cushion for an item of furniture for limiting effects caused by contact of the item with a stationary object, the cushion including:

a cylindrical deformable pad portion which is capable of returning to a cylindrical shape after experiencing up to 50 percent compression; and a furniture attachment portion having a generally planar first face capable of overlying and being supported by a surface of such an item of furniture, said attachment portion further having a second concave support face to which said pad portion is adhered opposite said first face, said attachment portion further having a pair of oppositely located tab portions each of which extends beyond an end of said concave support face and said pad portion when adhered thereto, each of said tab portions having a planar surface which is generally coplanar with said first face, said attachment portion being sufficiently rigid to provide support for said pad during said up to 50 percent compression of said pad.

2. The cushion according to claim 1, wherein the attachment portion is made from a non-foaming polymeric material.

3. The cushion according to claim 2, wherein the attachment portion is made from a polyethylene material.

4. The cushion according to claim 1, wherein the pad portion is made from a foaming polymeric material.

5. The cushion according to claim 4, wherein the pad portion is made from a polyurethane material.

6. The cushion according to claim 1, wherein the pad portion is a separate member which is adhered to the second face of the attachment portion.

7. The cushion according to claim 6, wherein the pad portion is cylindrical and wherein the second face of the attachment includes a concave surface portion onto which at least a portion of the cylindrical pad is placeable in a confronting and interfitting relationship, the pad portion being adhered to the concave surface portion.

8. The cushion according to claim 1, wherein each of said tab portions has at least one opening and wherein said cushion further includes connecting members each of which extends through one of said openings.

9. The cushion according to claim 8, wherein an attachment means further includes connecting members each of which extends through one of said tab portion openings.

10. The cushion according to claim 8, wherein the surface of such an item of furniture is non-planar and wherein the cushion further includes a pair of elongated attachment straps each having a length extending between opposing ends and conformable to the non-planar surface along the length, each of the straps having at least one opening adjacent to each of the opposing ends and a generally centrally located opening between the opposing ends for overlying one of the tab openings in the attachment portion.

11. The cushion according to claim 1, wherein the first face of the attachment portion includes at least one recessed portion.

12. The cushion according to claim 11, wherein the first face of the attachment portion includes a plurality of recessed portions each of which is separated from an adjoining recessed portion by a divider, the divider having a first face capable of overlying and contacting the surface of such an item of furniture.

13. The cushion according to claim 1 wherein the surface of such an item of furniture is non-planar and wherein the cushion further includes a layer of moldable material which hardens after attachment of the cushion and which is operably connected to the first face of the attachment portion for conforming the cushion to the non-planar surface.

14. The cushion according to claim 13, further including a plate interposed between said layer of moldable material and said attachment portion, said plate adhered to the first face of the attachment portion.

15. The cushion according to claim 14, wherein each of said tab portions has at least one opening, said cushion further including connecting members each of which extends through one of said openings.

16. The cushion according to claim 15, wherein an attachment means further includes connecting members each of which extends through one of said tab portion openings.

17. The cushion according to claim 1 wherein the pad portion comprises a dense essentially pore free outer skin enveloping a molded foamed elastomere core.

* * * * *